US007007516B2

(12) United States Patent
Sauter

(10) Patent No.: US 7,007,516 B2
(45) Date of Patent: Mar. 7, 2006

(54) LATCH NEEDLE FOR A LOOP-FORMING TEXTILE MACHINE

(75) Inventor: Manfred Sauter, Stetten am kalten Markt-Storzingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/099,535

(22) Filed: Apr. 6, 2005

(65) Prior Publication Data

US 2005/0217322 A1 Oct. 6, 2005

(30) Foreign Application Priority Data

Apr. 6, 2004 (EP) ..... 04008294

(51) Int. Cl.
*D04B 35/04* (2006.01)

(52) U.S. Cl. ..... 66/121

(58) Field of Classification Search ..... 66/121, 66/116, 117, 122

See application file for complete search history.

(56) References Cited

U.S. PATENT DOCUMENTS

| | | | | |
|---|---|---|---|---|
| 1,818,746 | A * | 8/1931 | Parlini | 66/121 |
| 1,824,445 | A * | 9/1931 | Parlini | 66/121 |
| 2,596,311 | A | 5/1952 | Vitoux | |
| 2,817,222 | A * | 12/1957 | Noe | 66/121 |
| 4,294,086 | A | 10/1981 | Mayer et al. | |
| 4,601,180 | A | 7/1986 | Mayer et al. | |
| 4,817,398 | A | 4/1989 | Sos et al. | |
| 2002/0152774 | A1 * | 10/2002 | Sauter et al. | 66/121 |

FOREIGN PATENT DOCUMENTS

| | | |
|---|---|---|
| DE | 2 225 835 | 12/1972 |
| DE | 27 14 607 | 10/1978 |
| DE | 33 31 031 A1 | 3/1985 |
| EP | 0 291 687 A1 | 11/1988 |

* cited by examiner

*Primary Examiner*—Danny Worrell
(74) *Attorney, Agent, or Firm*—Fitch, Even, Tabin & Flannery; Norman N. Kunitz; George H. Spencer

(57) ABSTRACT

The latch needle (1) of the invention has a latch (7), which is provided on its free end, on its side facing away from the hook (3), with one or more recesses (18, 19). The function of these recesses is to reduce the moment of inertia of the latch (7), which leads to an increased service life of the latch. Between the recesses (18, 19), a rib remains, whose top side functions like a skid for loops to be transferred. The indentations (18, 19) are preferably elongated depressions. However, corresponding openings may be provided as a substitute instead.

13 Claims, 4 Drawing Sheets

LATCH NEEDLE FOR A LOOP-FORMING TEXTILE MACHINE

CROSS REFERENCE TO RELATED APPLICATION

This application claims the priority of European Patent Application No. 04 008 294.3, filed on Apr. 6, 2004, the subject matter of which, in its entirety, is incorporated herein by reference.

FIELD OF THE INVENTION

The invention relates to a latch needle for a loop-forming textile machine, in particular for a knitting machine.

BACKGROUND OF THE INVENTION

In knitting machines or in other loop-forming machines, so-called latch needles are often employed, which for forming loops are moved back and forth in rapid succession. The latches, which are provided on the needles and pivotably supported, open and close in rapid succession. In the process, they strike the hook of the latch needle and its shank in alternation. Because of the high accelerations that the latch needles and hence the latches are exposed to, breaks of the latch shank can occur. In the past, the attempt was made by various procedures to reduce the number of latch shank breaks. For instance, European Patent Disclosure EP 0 291 687 proposes a latch of fiber-reinforced thermoplastic. However, this concept has not been successful in practice.

From German Patent DE-PS 27 14 607, it is known to damp the impact of the needle latch in the standing position by means of a special design of the longitudinal slot of the needle and thereby to avoid damage to the needle latch and to the needle itself that might occur in the standing position of the needle latch. To that end, the latch back has flanks that converge in wedgelike fashion and are capable of spreading the longitudinal slot of the needle open somewhat. However, narrow limits are set to the elastic spreading open of the needle shank cheeks.

It is also known from U.S. Pat. No. 2,596,311 to make provisions for reducing the forces of inertia that occur in the region of the needle latch by providing continuous recesses or regions of reduced wall thickness. This reference pertains to mending needles, for repairing stockings or other knitted products. The needle latch, on its end that cooperates with the needle hook, has an integrally formed-on extension that is multiple times longer than the actual latch length. To reduce its weight, it is provided with continuous recesses in the form of circular holes, or is embodied throughout with a reduced wall thickness compared to the actual needle latch. However, in these mending needles, which cannot be compared with normal needle latches, the needle latch itself is bulky, and a spoon is dispensed with.

German Patent Disclosure DE 33 31 031 A1 discloses a latch needle with a latch whose shank, in the region between its bearing point and the pivotable spoon, is provided with one or more recesses, for instance in the form of through bores. However, these recesses lead to a considerable weakening of the shank, which can cause latch shank breakages.

Another way of avoiding latch shank breakages is offered by German Published, Unexamined Patent Disclosure DE-OS 2 225 835. In it, it is proposed that the latch shank be provided with reinforcing ribs that are intended to stiffen the latch shank. The reinforcing ribs do not lead directly to a reduction in latch shank breakage.

Taking the above as the point of departure, it is the object of the invention to disclose a latch needle for a loop-forming textile machine that is intended to have a reduced tendency to latch breakage.

SUMMARY OF THE INVENTION

The above object generally is achieved by the latch needle of the invention for a loop-forming textile machine, in particular a knitting machine, which generally includes a needle body with a hook disposed on one end of the needle body and a bearing device disposed on the needle body in the vicinity of the hook. At least one or even a plurality of indentations, are provided on the opposite end of the latch remote from the bearing device in addition to the shaped face that is present anyway. The shaped face is for instance a spoonlike depression for receiving the hook tip (grooved-latch needle). The shaped face may also be a riblike or slightly arching protrusion that engages a recess of the hook (grooved-hook needle). In both cases, the at least one indentation according to the invention is located on the free end of the latch, that is, approximately in the region that comes into contact with the hook. The indentation reduces the total weight of a latch slightly. Because of the great distance of the indentation from the pivot axis, this reduction has a disproportionate influence on the moment of inertia of the latch. Even a slight weight reduction thus causes a considerable reduction in the moment of inertia. In experiments, depending on the embodiment of the indentation, it was possible to reduce the moment of inertia by between 5% and 10% compared to commercially available needles without an indentation. As a result, wear to the hook tip, to the shaped face of the latch, and possibly also to the latch bearing can also be reduced. Tests have shown that the risk that the knitting tool will be destroyed, for instance by breakage of cheeks, latch holes, latch heads, and latch noucats, is reduced. Thus the latch needles of the invention when used in the conventional way have an increased service life. On the other hand, they also make it possible to increase the operating speed (machine rpm). The indentations are disposed for instance on a side of the latch remote from the hook. They differ in this respect from the shaped face oriented toward the hook, which may be embodied as a depression or as a protrusion. The indentations are preferably embodied as relatively shallow depressions, whose flanks preferably extend away from one another at an obtuse angle. The tendency of accumulations of deposits in these depressions is thus averted.

Preferably, two recesses are provided on the side and back faces of the latch. If the depressions are disposed on the oblique side faces of the latch that are remote from the hook, approximately at the level of the center of surface area of the cross section of the latch head, then high rigidity of the latch is furthermore achieved.

Instead of the depressions, the indentations may also be embodied as openings or may include openings. This can be utilized for a further reduction in the moment of inertia of the latch without substantially impairing its strength or rigidity. Moreover, such openings or other kinds of recesses have hardly any harmful influence on the strength of the latch, when they are disposed in the end region of the latch. The end region is considered to the portion of the latch that cooperates with the hook and comes into contact with it.

Further details of advantageous embodiments of the invention will become apparent from the drawing, description, or claims.

BRIEF DESCRIPTION OF THE DRAWINGS

In the drawings, exemplary embodiments of the invention are shown. Shown are.

DETAILED DESCRIPTION OF THE INVENTION

Figure 1:
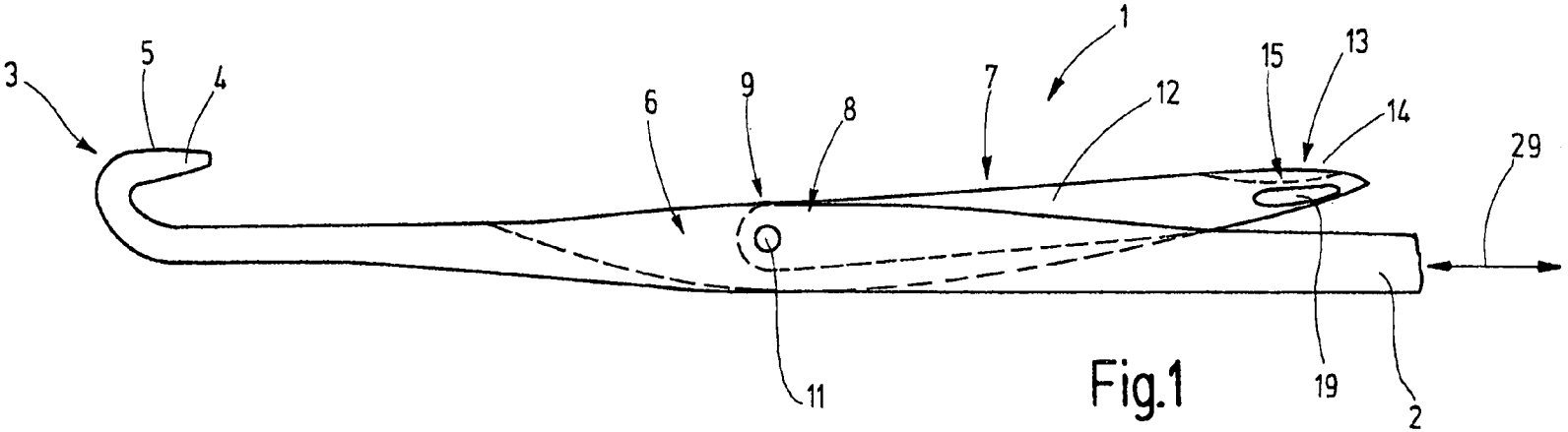
FIG. 1, a grooved-latch needle with an improved latch, shown in a schematic fragmentary side view with the latch in the standing position.

In FIG. 1, a latch needle 1 is shown, which has a needle body 2 with a hook embodied on its end. The hook 3 is provided with a tip 4, which may be rounded on its top side 5.

Not far away from the hook 3 in the needle body 2, a latch slot 6 is provided, into which a latch protrudes by one end 8. The latch is held and pivotably supported in the latch slot 6 on a bearing device 9. The bearing device 9 is preferably formed for example by a one-piece or multi-piece pin 11 passing transversely through the latch slot 6. The latch 7 can be pivoted about this pin 11 out of the standing position shown in FIG. 1 into the closing position shown in FIG. 2.

Figure 2:
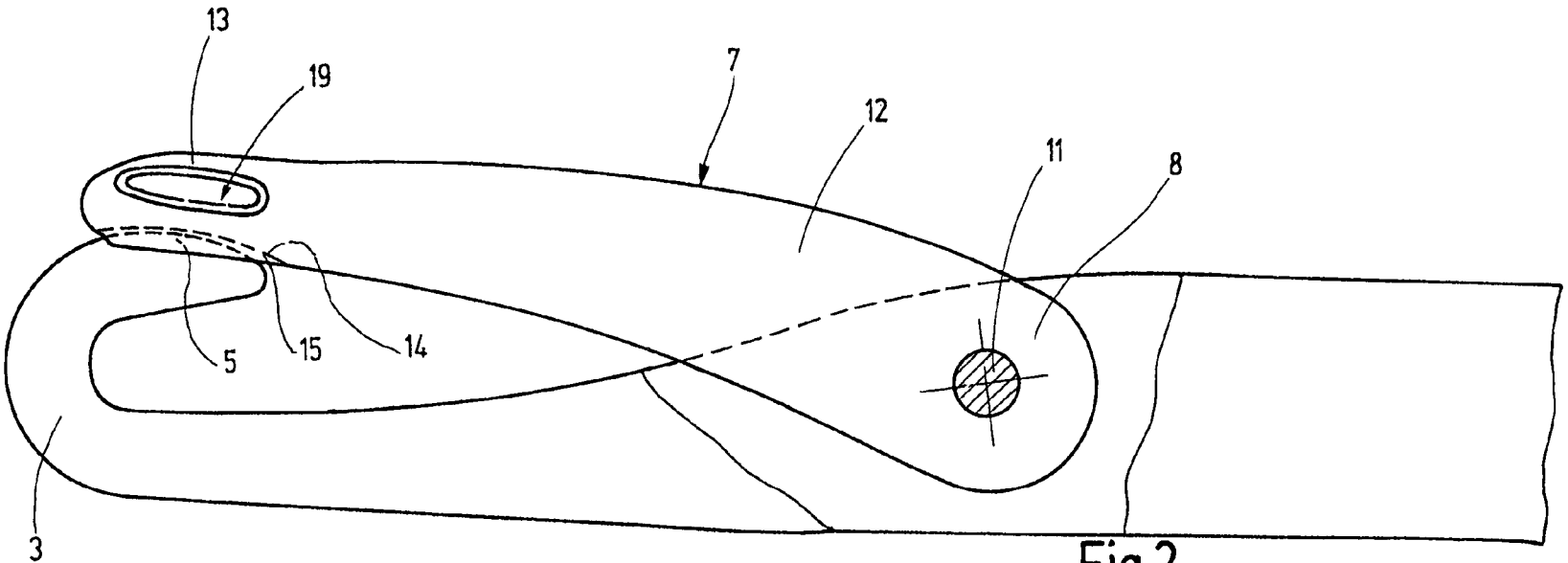
FIG. 2, the latch needle of FIG. 1 in a schematic side view, with the latch in the closing position and on a different scale.

The latch has a narrow shank 12, which is preferably defined by parallel flanks and whose width is slightly less than that of the latch slot 6. The length of the latch 7 is dimensioned such that with its end 13 it can reach the top side 5 of the hook 3. The end 13, on the side toward the hook 3, is provided with a shaped face 14, which in the exemplary embodiment of FIGS. 1 and 2 forms a depression 15 for receiving at least a portion of the hook 3. The depression 15 may, as FIG. 2 shows, be adapted to the top side 5 of the hook 3.

Figures 3, 4:
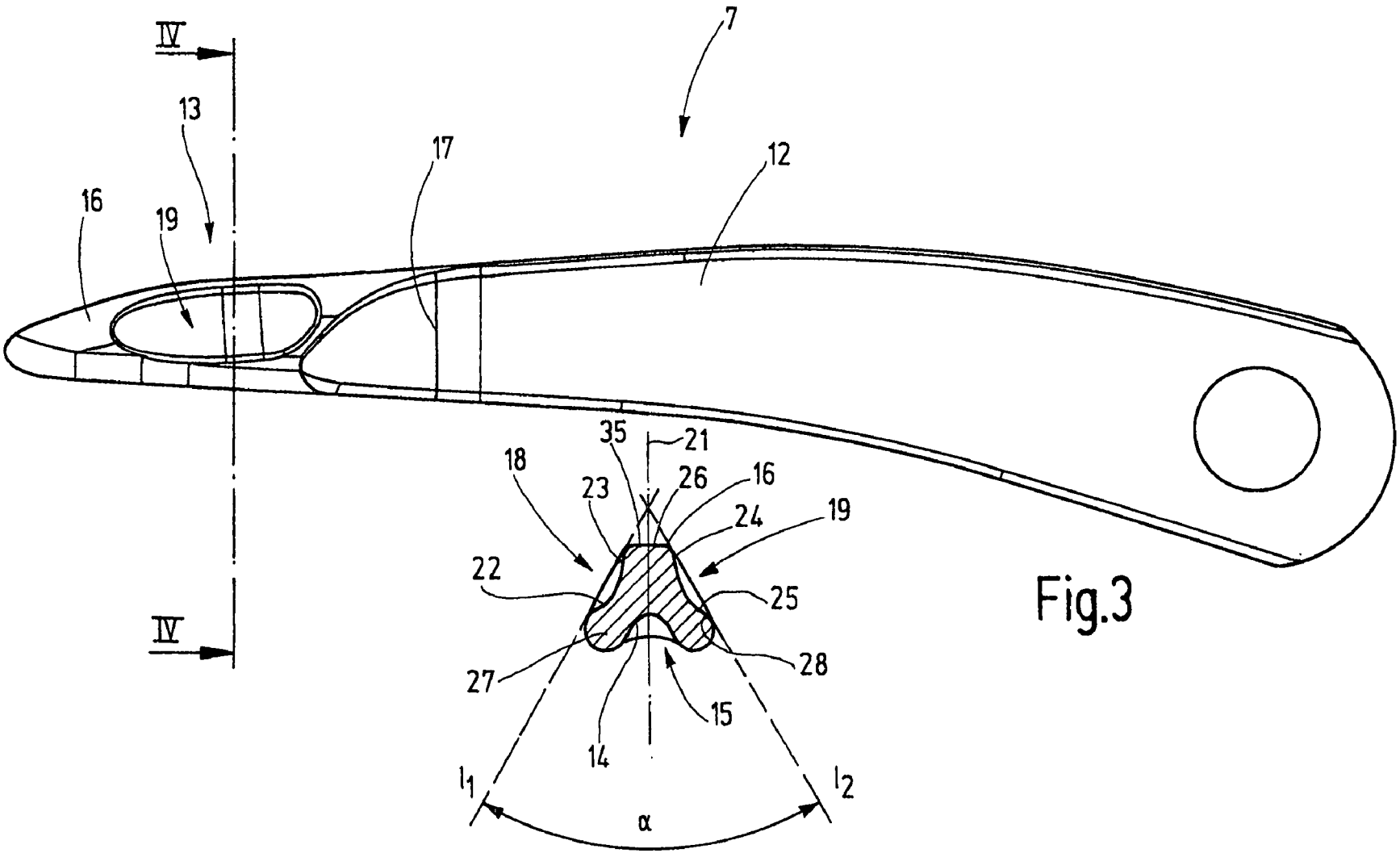
FIG. 3, the latch of the latch needle of FIGS. 1 and 2 in a side view.
FIG. 4, the latch of FIG. 3, in a section taken along the line VI—VI.
Figure 5:
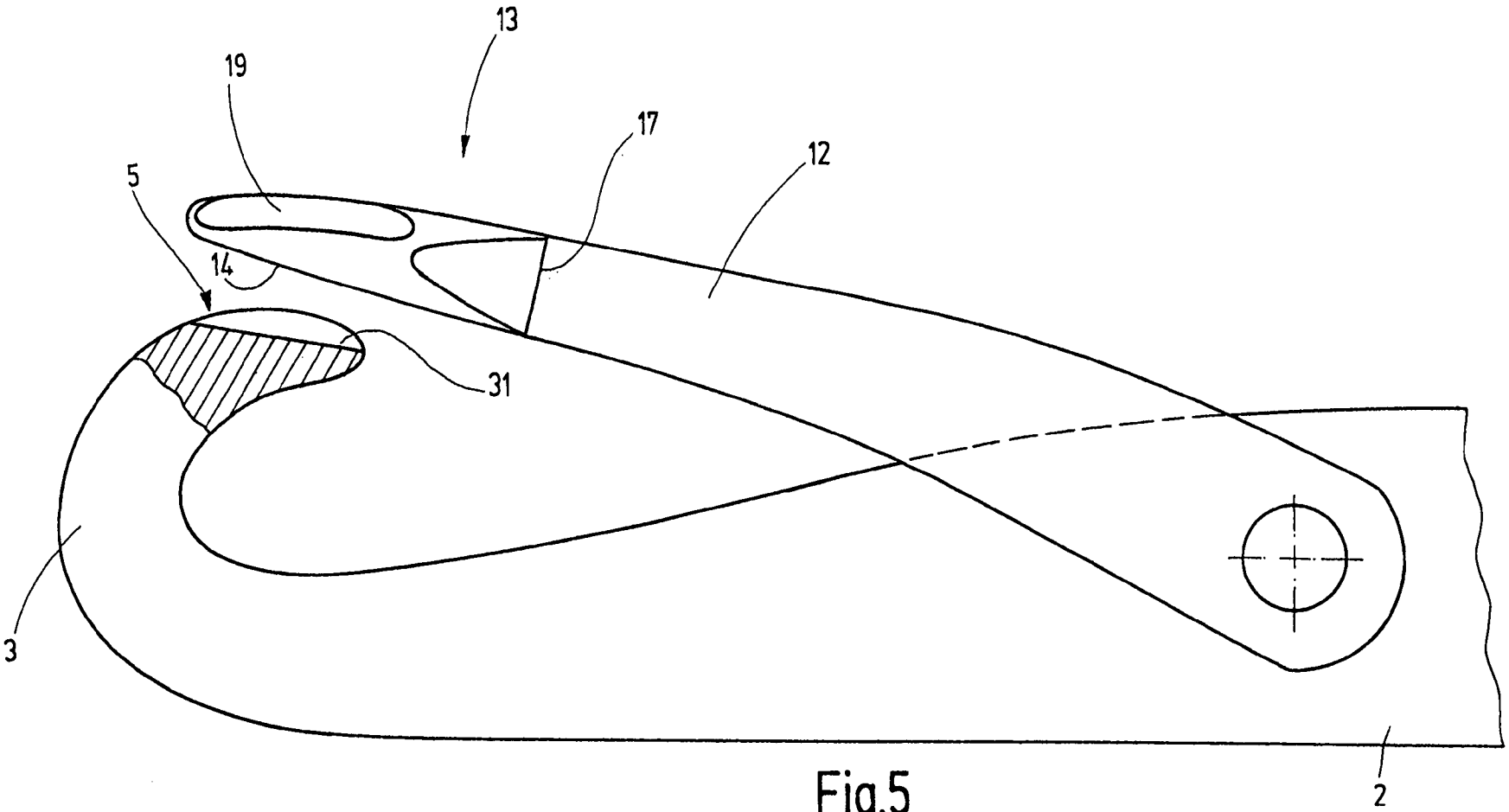
FIG. 5, a grooved-hook latch needle, in a fragmentary side view.
Figure 6:
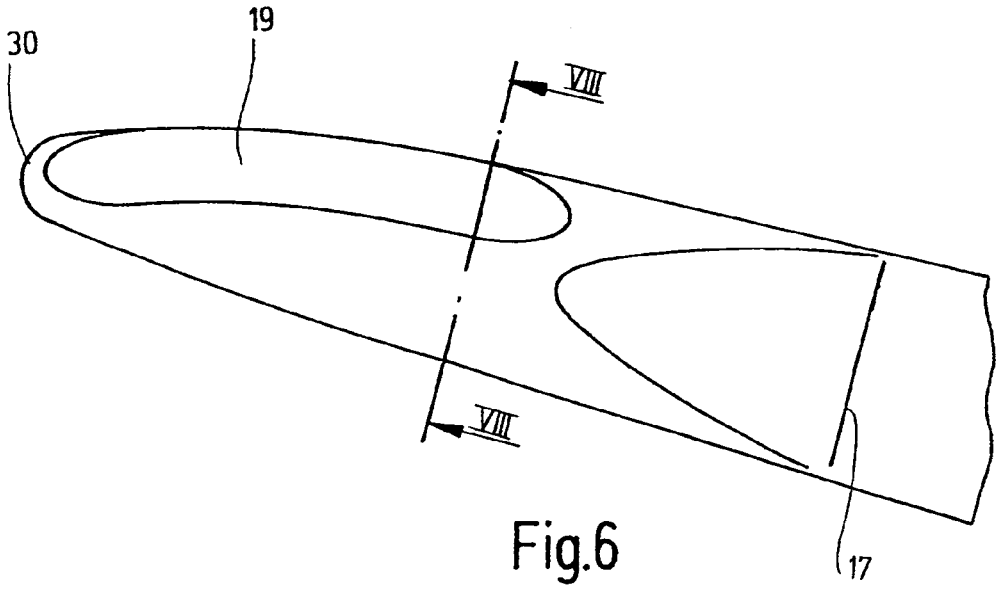
FIG. 6, the latch of the grooved-hook latch needle of FIG. 5 in a fragmentary side view on a different scale.

The embodiment of the end 13 of the latch 7 is further seen in FIGS. 3 and 4. The end 13 has a side and back face 16, which forms the back side of a spoon embodied on the end of the latch 7. This spoon marks the end 13 of the latch 7. Its width exceeds the width of the essentially parallel-flanked shank 12. The transition between the shank 12 and the end 13 is located approximately at a line 17. At this line, the thickness of the latch 7, measured perpendicular to the side faces of the shank 12, begins to vary toward its end 13, increasing it first and then in its further course decreasing again.

In this region of the latch 7, that is, in the region of the end 13, there is at least one indentation. In the present exemplary embodiment, the end 13 is provided with two indentations 18, 19, which are disposed on the more lateral portions of the side and back face 16. Longitudinally they are somewhat ovoid, and they extend approximately parallel to the longitudinal direction defined by the latch 7. If the transition points with the side face 16 of the indentations 18, 19 are connected to one another (see cross section in FIG. 4, line $l_1$ and line $l_2$), then the connecting lines $l_1$, $l_2$ form a right or acute angle $\alpha$ with one another. The indentations 18, 19 are disposed symmetrically to a longitudinal-center plane 21, to which the pivot axis, defined by the bearing device 9, of the latch 7 is perpendicular. The indentations 18,19 may be embodied or formed as rimless depressions. Their peripheral flanks, in pairs 22, 23 and 24, 25, may each form an obtuse angle for instance of 120°, with one another. The shaped face 14 and the depressions 18, 19 thus define a triangular cross section that can be considered to be symmetrical to the longitudinal-center plane 21. On its top side, remote from the hook 3, between the flanks 23, 24, it has a preferably parallel-flanked rib 26. Portions that remain between the flanks 22, 25 and the shaped face 14 may also be considered to be ribs 27, 28. This cross section proves to be especially resistant to flexing.

The latch needle 1 described thus far functions as follows:

In operation, the latch needle 1 is moved back and forth in its longitudinal direction, represented in FIG. 1 by an arrow 29. In the process, the latch continuously swings back and forth between its standing position (FIG. 1) and its closing position (FIG. 2). In the closing position, the shaped face 14 rests partly on the hook 3. In the standing position, conversely, the hook 3 is uncovered. As it swings back and forth, the latch 7 gains kinetic energy, which upon impact in the standing position or on striking the hook 3 leads to an impact load on the hook 3 and the latch 7. In comparison to a latch 7 of the same shape but without such indentations, the indentations 18, 19 reduce the kinetic energy that must be converted considerably. Even relatively shallow indentations 18, 19 can reduce the energy, for the same operating speed, by 5% to 10%. The result is a lesser load both on the top side 5 of the hook 3 and on the shaped face 14. Moreover, the impact affecting the latch 7 is lessened, which leads to a significantly reduced number of breaks in the region of the shank 12 of the latch 7. Breaks in the region of the end 13 of the latch 7 are also reduced.

Figure 7:
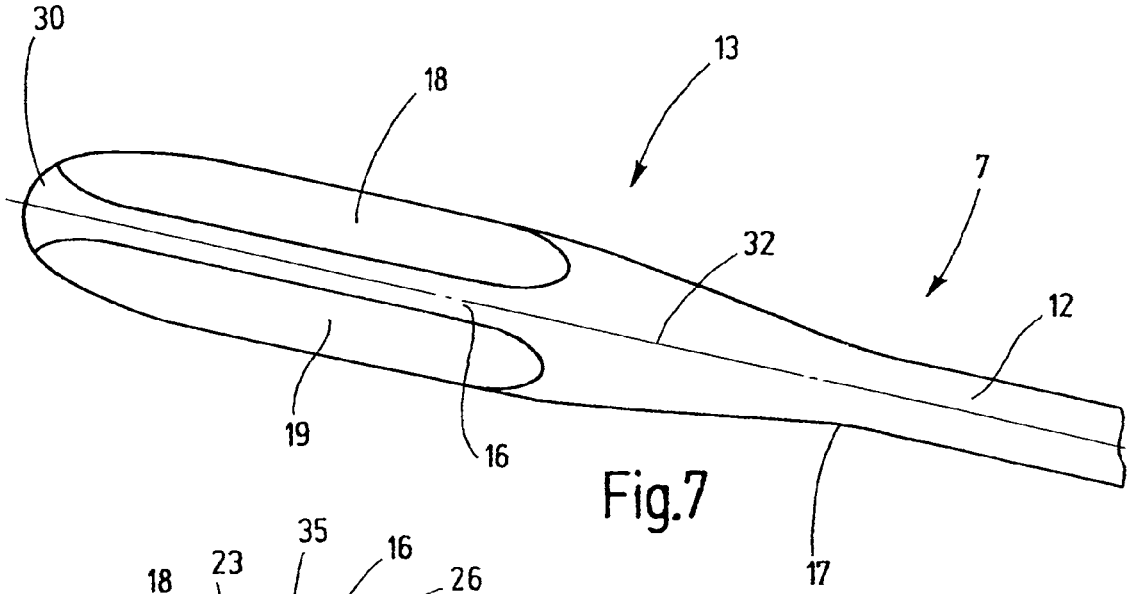
FIG. 7, the latch of FIG. 6, in a fragmentary top view.
Figure 8:
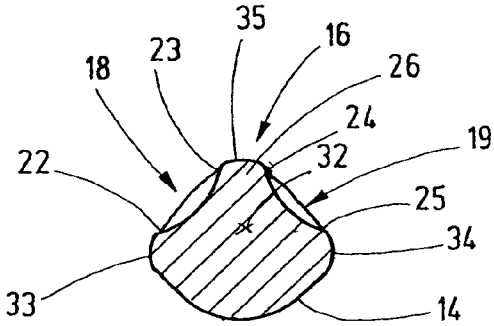
FIG. 8, the latch of FIG. 6, in a section taken along the line VIII—VIII.

FIGS. 5 through 8 illustrate a modified embodiment of the latch needle 1 in a fragmentary view and in detail. To the extent that agreement with the above description exists, reference is made to it, using the same reference numerals. In a departure from the above description, the following is true:

The hook 3 is provided on its top side 5 with a so-called noucat 31, which may be considered as a depression extending either in the longitudinal direction of the needle or inclined relative to it, or as a groove-like recess. The shaped face 14 embodied on the end 13 is adapted to the shape of the noucat 31. As FIG. 6 and particularly FIG. 8 show, the shaped face may be curved approximately cylindrically about the longitudinal axis 32 of the latch (FIG. 7). The shaped face 14 here is curved convexly, while the shaped face 14 in the exemplary embodiment of FIGS. 1 through 3 is curved concavely.

As in the exemplary embodiment described first above, the end 13, which is embodied as widened compared to the shank 12, is provided with indentations 18, 19 in the form of depressions. These depressions extend as much as possible as far as the tip 30 of the latch 7. They each begin at the lateral flanks 33, 34 of the end of the latch and extend, curved concavely, as far as its top side 35. In the simplest case, the indentations 18, 19 describe a circular profile or circular arc. However, still other shapes of indentation may be employed as well. Preferably, smooth shapes, that is, without kinks or corners, are employed here. Moreover, the outline of the indentations 18, 19 is free of corners, and the edge defining the indentations 18, 19 is rounded. This avoids injuries to loops sliding over the latch 7 as well as other negative functional effects.

The entire end region 13 of the latch 7 of the latch needle 1 of the invention may have an indentation 18, 19 at an arbitrary place. For instance, this indentation 18, 19 may be disposed in the extension of the recess 14, below the tips 30 of the latch.

The latch needle 1 of the invention has a latch 7, which is provided on its free end, on its side facing away from the hook 3, with one or more recesses 18, 19. The function of these recesses is to reduce the moment of inertia of the latch 7, which leads to an increased service life of the latch. Between the recesses 18, 19, a rib remains, whose top side functions like a skid for loops to be transferred. The indentations 18, 19 are preferably elongated depressions. However, corresponding openings may be provided as a substitute instead.

It will be appreciated that the above description of the present invention is susceptible to various modifications, changes and adaptations, and the same are intended to be comprehended within the meaning and range of equivalents of the appended claims.

List of Reference Numerals

1 Latch needle
2 Needle body
3 Hook
4 Tip
5 Top side
6 Latch slot
7 Latch
8 End
9 Bearing device
11 Pin
12 Shank
13 End
14 Shaped face
15 Depression
16 Side and back face
17 Line
18, 19 Indentations
21 Longitudinal-center plane
22, 23, 24, 25 Flanks
26, 27, 28 Ribs
29 Arrow
30 Latch tip
31 Noucat
32 Longitudinal axis of latch
33, 34 Flanks
35 Top side

What is claimed is:

1. A latch needle for a loop-forming textile machine, including:

a needle body, a hook formed on the needle body, and a bearing device disposed on the needle body in the vicinity of the hook, and, a latch, which is held and pivotably supported on the bearing device by one end, and whose other end has a shaped face associated with and facing the hook; and wherein the latch, on its other end, has at least one indentation disposed in an outer face of the latch other than the shaped face.

2. The latch needle of claim 1, wherein the indentation is disposed on a side of the latch facing away from the hook.

3. The latch needle of claim 1, wherein the indentation is embodied as a depression.

4. The latch needle of claim 1, wherein the indentation is embodied in elongated form.

5. The latch needle of claim 4, wherein the indentation is disposed longitudinally to the latch.

6. The latch needle of claim 1, wherein two indentations are embodied on the latch.

7. The latch needle of claim 6, wherein the two indentations are oriented at an acute angle or parallel to one another in the longitudinal direction.

8. The latch needle of claim 6, wherein the two indentations in cross section, at the points of transition of the outer face with their edges, define lines ($l_1$, $l_2$), which form a right or acute angle $\alpha$ with one another.

9. The latch needle of claim 1, wherein the latch has a spoon shape on whose outer side and back face the at least one indentation is embodied.

10. The latch needle of claim 8, wherein the shaped face is a recess oriented toward and facing the hook.

11. The latch needle of claim 1, wherein the hook is provided with a noucat for receiving at least a portion of the shaped face.

12. The latch needle of claim 1, wherein the at least one indentation is generally ovoid in shape extending in a longitudinal direction of the latch.

13. The latch needle of claim 7, wherein the two indentation are each generally ovoid in shape.

* * * * *